United States Patent [19]

Hupfer et al.

[11] Patent Number: 4,996,956

[45] Date of Patent: Mar. 5, 1991

[54] BREATHER APPARATUS FOR INTERNAL COMBUSTION ENGINES

[75] Inventors: Gregory L. Hupfer, West Bend; Gregory R. Schmidt, Port Washington; Thomas A. McNabb, Milwaukee, all of Wis.

[73] Assignee: Briggs & Stratton Corporation, Wauwatosa, Wis.

[21] Appl. No.: 492,591

[22] Filed: Mar. 12, 1990

[51] Int. Cl.[5] ..... F01M 1/00

[52] U.S. Cl. ..... 123/196 CP; 123/41.86

[58] Field of Search ..... 123/41.86, 572, 196 CP

[56] References Cited

U.S. PATENT DOCUMENTS

| | | | |
|---|---|---|---|
| 3,931,812 | 1/1976 | Ashfield et al. | 123/196 CP |
| 4,291,650 | 9/1981 | Formia et al. | 123/41.82 A |
| 4,470,389 | 9/1984 | Mitadera et al. | 123/196 CP |
| 4,501,234 | 2/1985 | Toki et al. | 123/41.86 |
| 4,502,424 | 3/1985 | Katoh et al. | 123/41.86 |
| 4,565,164 | 1/1986 | Satoh et al. | 123/41.86 |
| 4,569,323 | 2/1986 | Okumura | 123/572 |
| 4,579,092 | 4/1986 | Kandler | 123/41.86 |
| 4,601,267 | 7/1986 | Kronich | 123/41.86 |
| 4,602,592 | 7/1986 | Aoki et al. | 123/41.86 |
| 4,656,991 | 4/1987 | Fukuo et al. | 123/572 |
| 4,662,322 | 5/1987 | Tamba et al. | 123/41.86 |
| 4,681,068 | 7/1987 | Anno et al. | 123/41.86 |
| 4,727,834 | 3/1988 | Isaka et al. | 123/196 CP |

*Primary Examiner*—E. Rollins Cross

*Attorney, Agent, or Firm*—Andrus, Sceales, Starke & Sawall

[57] ABSTRACT

Breather apparatus is disclosed for relieving engine crankcase pressure when the engine is tipped or rotated. The breather apparatus consists of a duct intake connected to the crankcase, an elongated duct, and a drain hole for draining oil back into the crankcase. The duct intake should be positioned in an area of low oil splash. The drain hole should be positioned so that it is not submerged in oil while being tipped 90° in either a clockwise or a counter-clockwise direction about the engine's vertical centerline. The breather assembly is particularly suitable for lawnmowers that are tipped during cleaning.

9 Claims, 2 Drawing Sheets

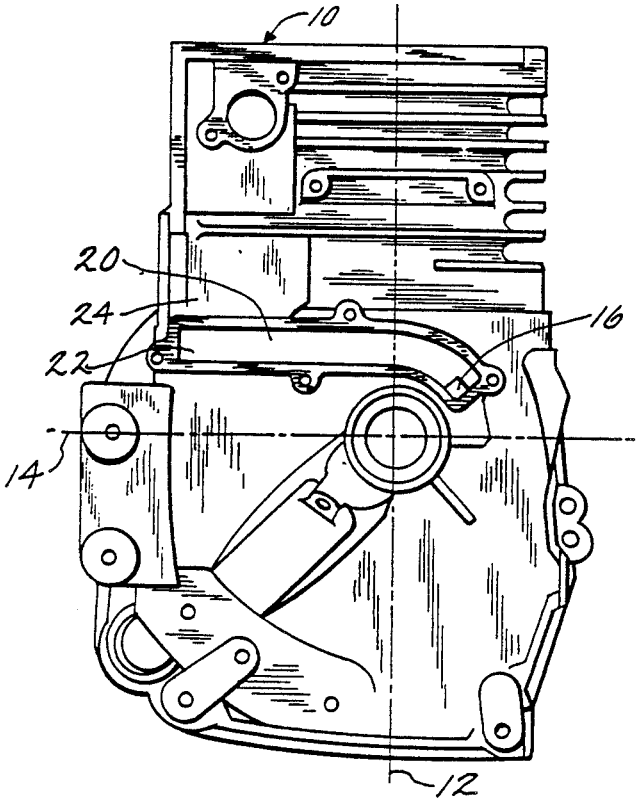
FIG. 1
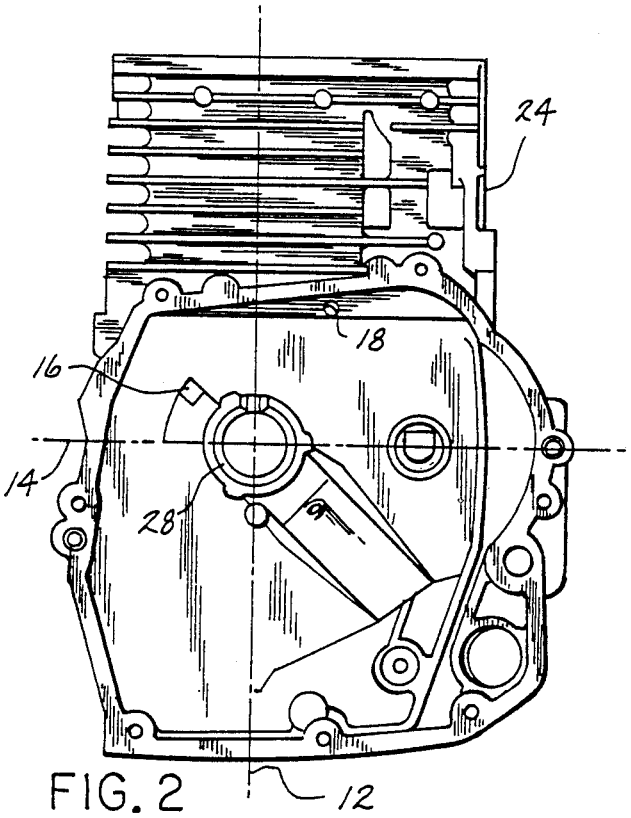
FIG. 2
FIG. 3
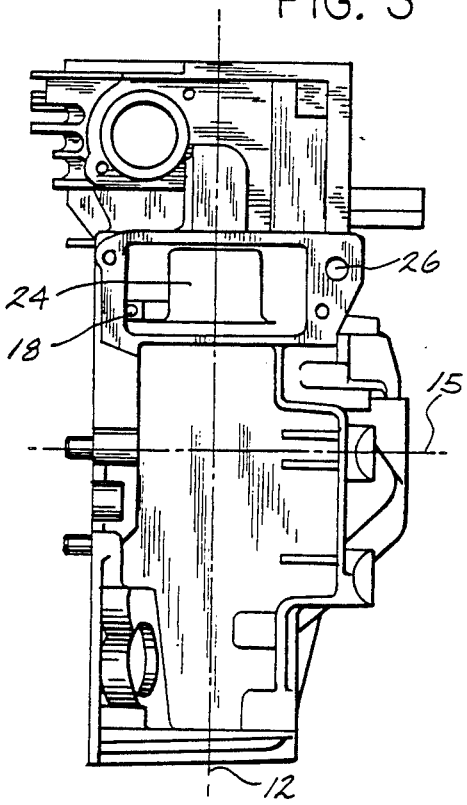

BREATHER APPARATUS FOR INTERNAL COMBUSTION ENGINES

BACKGROUND OF INVENTION

This invention relates to internal combustion engines, and more particularly to a breather apparatus for such engines that relieves air pressure in the engine crankcase.

During the operation of an internal combustion engine, pressure develops within the crankcase—the compartment which contains both a lubricating fluid and air. Unless this pressure is relieved so that a partial vacuum is maintained in the crankcase, the lubricating fluid—typically oil—tends to leak through various seals and orifices in the engine compartment, resulting in engine malfunction. More specifically, the pressurized oil tends to flow into the intake of the engine's air cleaner, rendering the air cleaner unusable. Therefore, it is desirable to relieve the crankcase pressure that builds up due to engine operation by providing an escape for pressurized crankcase air.

Several breather techniques are known for relieving this engine crankcase pressure. Many of these breather techniques use complicated snap valves, duct valves, rubber valves, and one-way valves to relieve crankcase pressure without permitting the lubricating fluid from leaving the engine crankcase. Such prior art breathers contain an unnecessary number of parts, are unduly complicated, and expensive.

When the engine is a small engine used on lawnmowers, another problem occurs with prior art breather mechanisms. Lawnmower operators typically tip or rotate the lawnmower—and thus the engine—to one side or to the other for cleaning the underside of the lawnmower housing and the rotating blade. When the lawnmower engine is tipped, the engine's lubricating fluid may submerge the breather passageways, preventing crankcase pressure from being released. As discussed above, the unreleased crankcase pressure may then cause the crankcase lubricating fluid to leak through the seals or orifices in the engine compartment, resulting in engine or air cleaner malfunction.

It is therefore desirable to provide an engine breather mechanism that permits crankcase air pressure to be released even if the engine is rotated during cleaning.

SUMMARY OF THE INVENTION

Apparatus is disclosed that relieves crankcase pressure in an oil-containing crankcase of an internal combustion engine. The apparatus includes a breather duct, a breather duct intake in airflow communication with both the crankcase and with the breather duct, and a drain hole in fluid flow communication with both the breather duct and with the crankcase. The apparatus may also include a breather chamber in airflow communication with the breather duct and in fluid flow communication with the drain hole. An oil filter is preferably disposed within the breather chamber.

In a preferred embodiment, the breather apparatus is used in lawnmower engines. The breather duct intake and the drain hole are preferably located near the line about which the engine is rotated or tipped during cleaning of the lawnmower. The breather duct intake is located on a first side of the line, and the drain hole is located on the opposite side of the line. The breather duct intake and the drain hole are preferably located 2 inches or less about the line of rotation. The positioning of the intake and the drain hole near this line prevents both the drain hole and the intake from being submerged in crankcase oil when the engine is tipped for cleaning. Thus, either the duct intake or the drain hole will permit crankcase pressure to be released during lawnmower cleaning, preventing the otherwise pressurized crankcase oil from leaking out of the engine compartment to the air filter or otherwise.

It is a feature and advantage of the present invention to provide a breather apparatus that permits crankcase pressure to be relieved even when the engine is tipped.

It is another feature and advantage of the present invention to provide a breather apparatus that has no moving parts and is inexpensive to manufacture.

These and other features and advantages of the present invention will be apparent to those skilled in the art from the following detailed description and the drawings, in which:

BRIEF DESCRIPTION OF THE DRAWINGS

FIG. 1 is a top view of an engine having a breather assembly according to the present invention.

FIG. 2 is a bottom view of the engine depicted in FIG. 1 with the lower engine housing removed.

FIG. 3 is a top view of the engine depicted in FIG. 1 after the engine has been rotated 90° in a counterclockwise direction with respect to vertical centerline 12.

DETAILED DESCRIPTION OF THE PREFERRED EMBODIMENT

The present invention is designed to permit pressure in the lubricant and air-containing compartment of an internal combustion engine to be released at all times, particularly when the engine is being tipped or rotated for whatever reason.

A small engine used with a lawnmower is typically rotated about its vertical centerline during cleaning of the lawn mower blades and the undercarriage of the lawnmower. As used herein, the term "centerline" refers to the line about which the engine is turned or rotated. This line may or may not be the actual centerline of the engine.

The operator typically tips the lawnmower 90° to raise the right side of the lawnmower while spraying the underside with water. If the lawnmower engine is positioned on the lawnmower carriage so that the sparkplug is forward-facing, then the position of the engine corresponds to that of the engine depicted in FIG. 1. Raising the right side of the lawnmower in that case would result in a 90° counterclockwise rotation of the engine about vertical centerline 12.

Figure 5:
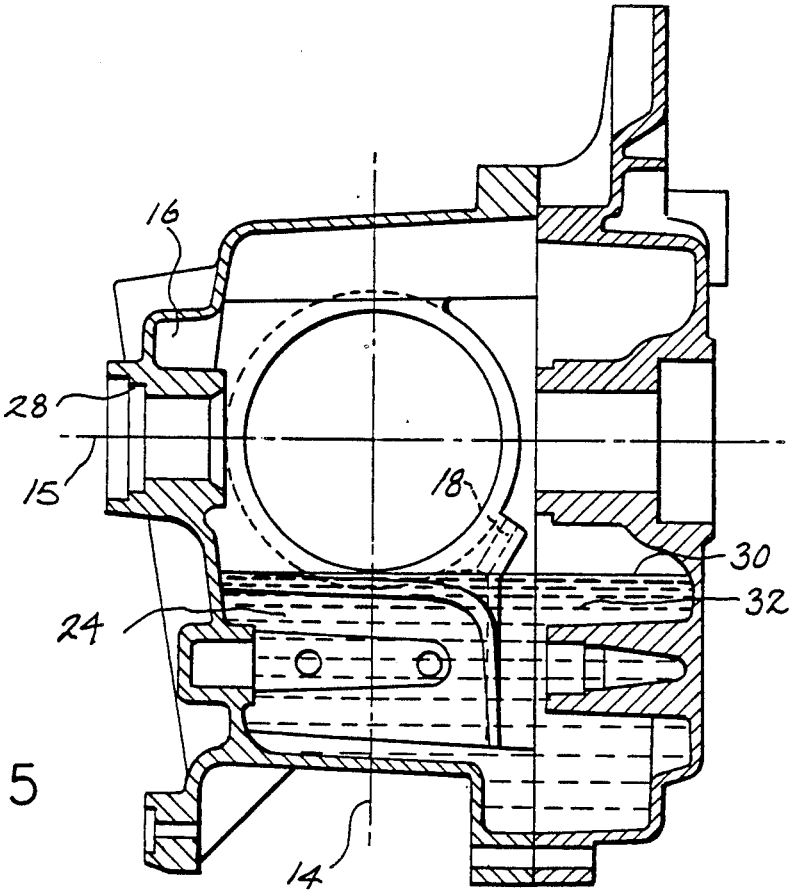
FIG. 5 is a cross-sectional view of the engine depicted in FIG. 1 after the engine has been rotated 90° about horizontal centerline 14 in a clockwise direction and then rotated 90° in the counterclockwise direction about vertical centerline 12.

Some lawnmower manufacturers assemble the lawnmower so that the sparkplug is facing toward the back of the lawnmower; the engine is thus rotated 180° with respect to third centerline 15 (FIG. 3) from the view depicted in FIG. 1. To clean such a lawnmower, the operator would also tend to tip the lawnmower to raise its right side (since most discharge chutes are on the right hand side), resulting in a 90° rotation in the counterclockwise direction about vertical centerline 12. A cross-section of the engine in this position is shown in FIG. 5.

Figure 4:
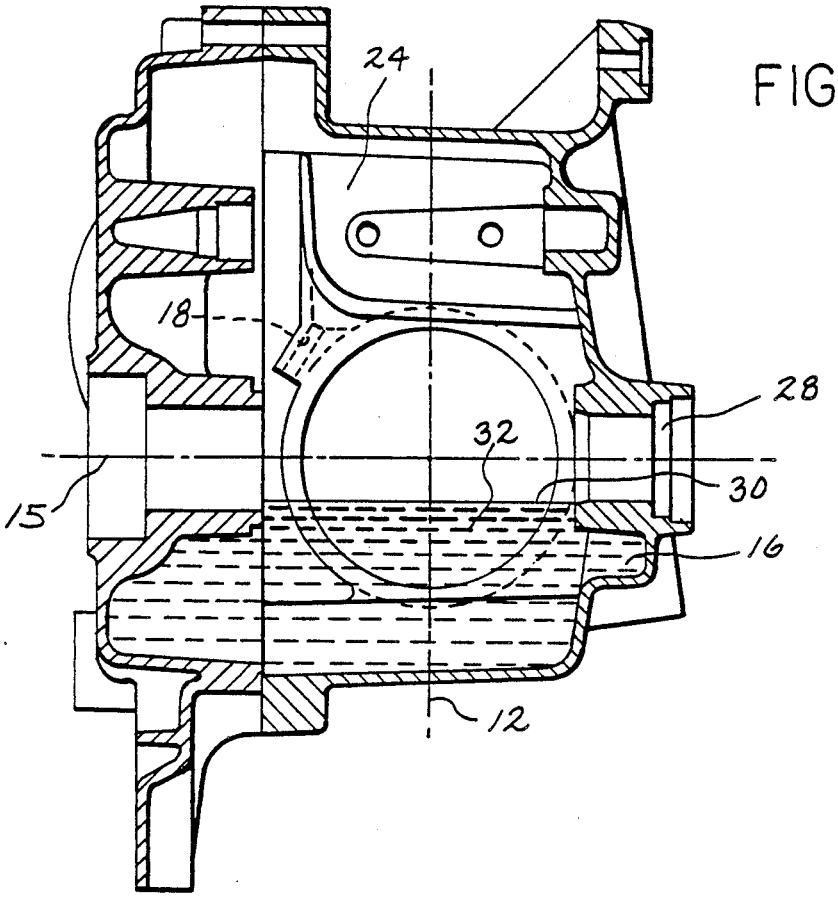
FIG. 4 is a cross-sectional view of the engine depicted in FIG. 1 after the engine has been rotated 90° about vertical centerline 12 in a clockwise direction, and then rotated 90° about third centerline 15 in a clockwise direction.

If on the other hand, the operator raises the left side of the lawnmower carriage where the engine is mounted so that the sparkplug is forward-facing, and a cross-section of the engine is taken so that the oil level may be seen, the resulting view is that shown in FIG. 4.

It has been discovered that positioning the breather duct intake 16 (FIG. 1) and the breather chamber drain hole 18 (FIG. 4) as close to vertical centerline 12 (see FIG. 2) as possible will permit at least one of duct intake 16 or drain hole 18 to be above the crankcase oil level—and thus not submerged in oil—when the engine is rotated for lawnmower cleaning. Duct intake 16 and drain hole 18 are preferably located within about 2 inches of vertical centerline 12. Duct intake 16 should be located in an area of low oil splash.

Referring now to FIG. 1, breather duct intake 16 is an intake means which is in airflow communication between the lubricant and air-containing engine compartment (the crankcase) and breather duct 20. Breather duct 20 is an elongated, substantially tubular duct cast in engine 10 that is in airflow communication with intake 16 and receives air and lubricant molecules from the intake means 16. Duct 20 is preferably rather long—about 4 inches in the engine of FIG. 1—to permit at least some of the lubricating oil molecules to condense within the duct. The opposite end 22 of duct 20 is in airflow and fluid flow communication with a breather chamber 24. As most clearly shown in FIG. 3, breather chamber 24 is a housing suitable for containing a foam-type oil filter (not shown) for capturing any remaining oil molecules transmitted to breather chamber 24 from duct 20.

As best shown in FIG. 3, breather chamber drain hole 18 is in fluid flow communication with duct 20 via breather chamber 24. Oil trapped in breather chamber 24 will drain from chamber 24 through drain hole 18 and back into the crankcase compartment. At the same time, crankcase pressure is relieved so that oil trapped in breather chamber 24 does not flow through air cleaner intake 26 into the air cleaner (not shown). If crankcase pressure resulting from piston movement and the hot engine is not relieved, crankcase oil may flow into air cleaner intake 26 to clog the air cleaner and thereafter prevent the engine from running. In the present invention, however, crankcase pressure is always relieved because drain hole 18 is always exposed to the atmosphere through breather chamber 24.

FIG. 2 is a bottom view of engine 10 of FIG. 1 with the lower engine housing removed. As shown in FIG. 2, breather duct intake 16 and drain hole 18 are located very close to vertical centerline 12. As shown in FIG. 2, the vertical and horizontal centerlines intersect at the center of crankshaft bearing bore 28, and thus at the center of the crankshaft itself (not shown).

FIGS. 4 and 5 are cross-sectional views which demonstrate that at least one of intake 16 and drain hole 18 is above the oil level 30 when the engine is tipped. In FIG. 4, drain hole 18 is above oil level 30 of crankcase oil 32, enabling crankcase pressure to be released through breather chamber 24. However, breather duct intake 16 is then submerged in oil 32. Drain hole 18 is located near to and on one side of vertical line 12 whereas duct intake 16 is located on the opposite side and relatively near vertical line 12. Although drain hole 18 and duct intake 16 are depicted as being diametrically opposed to each other, other configurations may be used.

FIG. 5 depicts a cross section of the engine when it is in another orientation. In FIG. 5, breather duct intake 16 is now located above oil level 30 and drain hole 18 is also located above oil level 30. Thus, both duct intake 16 and drain hole 18 are available for release of crankcase pressure.

Although a preferred embodiment of the present invention has been shown and described, other alternate embodiments will be apparent to those skilled in the art. Therefore, the scope of the present invention is to be limited only by the following claims.

We claim:

1. In a device having an engine that may be rotated about a line during cleaning of the device, the engine having a compartment containing a lubricant and air, an improved apparatus that relieves pressure in said compartment, comprising:

intake means, in airflow communication with said compartment and located on a first side of said line, for receiving air and lubricant molecules from said compartment;

duct means in airflow communication with said intake means for receiving air and lubricant molecules from said intake means and for condensing at least some of said lubricant molecules; and drain means, in fluid flow communication with both said duct means and with said compartment and located on a second side of said line opposite said first side, for receiving lubricant molecules and for transmitting lubricant molecules back to said compartment.

2. The improved apparatus of claim 1, wherein both said intake means and said drain means are located near said line.

3. The improved apparatus of claim 2, wherein both said intake means and said drain means are located within about 2 inches from said line.

4. The apparatus of claim 1, further comprising:

filter means for receiving lubricant molecules; and chamber means, in flud flow communication with both said duct means and with said drain means, for housing said filter means.

5. In a device having an engine that may be rotated about a line during cleaning of the device, the engine having a crankcase containing oil, an improved apparatus that relieves pressure in said crankcase, comprising:

a breather duct;

a breather duct intake in airflow communication with both said crankcase and with said breather duct, said duct intake being located on a first side of said line; and a drain hole in fluid flow communication with both said breather duct and with said crankcase, said drain hole being located on a second side of said line opposite said first side.

6. The improved apparatus of claim 5, wherein both said breather duct intake and said drain hole are located near said line.

7. The improved apparatus of claim 6, wherein both said breather duct intake and said drain hole are located within about 2 inches from said line.

8. The apparatus of claim 5, further comprising:

a breather chamber in airflow communication with said breather duct and in fluid flow communication with said drain hole.

9. The apparatus of claim 8, further comprising:

an oil filter disposed within said breather chamber.

* * * * *

UNITED STATES PATENT AND TRADEMARK OFFICE

CERTIFICATE OF CORRECTION

PATENT NO. : 4,996,956

DATED : March 5, 1991

INVENTOR(S) : GREGORY L. HUPFER ET AL

It is certified that error appears in the above-identified patent and that said Letters Patent is hereby corrected as shown below:

Claim 4, column 4, line 42, delete "flud" and substitute therefor -- fluid --.

Signed and Sealed this

Fourth Day of August, 1992

*Attest:*

DOUGLAS B. COMER

*Attesting Officer*

*Acting Commissioner of Patents and Trademarks*